US005310359A

United States Patent [19]

Chadbourne et al.

[11] Patent Number: 5,310,359

[45] Date of Patent: May 10, 1994

[54] CABLE CONNECTOR WITH STRAIN RELIEF

[75] Inventors: Richard Chadbourne, Anaheim; Scott D. Magovern, Huntington Beach; Robert A. Miller, Anaheim Hills, all of Calif.

[73] Assignee: Molex Incorporated, Lisle, Ill.

[21] Appl. No.: 75,152

[22] Filed: Jun. 10, 1993

[51] Int. Cl.[5] ..... H01R 13/59

[52] U.S. Cl. ..... 439/462; 439/98; 439/584; 439/610; 439/840

[58] Field of Search ..... 439/98, 349, 583, 584, 439/819, 840, 610, 462

[56] References Cited

U.S. PATENT DOCUMENTS

| | | | |
|---|---|---|---|
| Re. 33,611 | 6/1991 | Michaels et al. | 439/610 |
| 3,739,076 | 6/1973 | Schwartz | 174/78 |
| 4,355,854 | 10/1982 | Williams | 339/89 R |

FOREIGN PATENT DOCUMENTS

| | | | |
|---|---|---|---|
| 3721965 | 1/1989 | Fed. Rep. of Germany | 439/840 |

OTHER PUBLICATIONS

Glenair Sales Publication For EMI/RFI G-Spring Backshells Dated 1988, p. 219.

Sunbank Publication Entitled: Uni-Adaptor with RFI Environmental and Strain Relief Options, p. 35.

*Primary Examiner*—Eugene F. Desmond

*Attorney, Agent, or Firm*—Stacey E. Caldwell

[57] ABSTRACT

A connector backshell assembly is provided for strain relief mounting to an electrical cable. The assembly includes a backshell having forward and rearward ends and an axially extending cable-receiving aperture therethrough. A toroidally configured, radially compressible strain relief coil spring surrounds the cable and is disposed near the rearward end of the backshell. A compression nut is engageable with the backshell for selective rotational and axial movement relative thereto. The compression nut includes a forwardly facing concave cam surface for engaging and radially compressing the coil spring into strain relief engagement with the cable. An interference surface is operatively associated with the backshell and non-rotatably engageable with the strain relief coil spring to prevent rotation of the coil spring with the compression nut relative to the backshell.

8 Claims, 5 Drawing Sheets

CABLE CONNECTOR WITH STRAIN RELIEF

FIELD OF THE INVENTION

This invention generally relates to the art of electrical connectors and, more particularly, to a cable connector which is provided with improved strain relief. As disclosed herein, the invention is incorporated in a backshell assembly, particularly a sealed backshell assembly.

BACKGROUND OF THE INVENTION

Electrical cables, such as shielded cables, and associated connectors frequently are used in military applications and other industrial cable assembly applications. In such applications, the connector/cable interface often is environmentally sealed and should provide a superior strain relief connection to ensure that the quality of the electrical connection is not affected by any physical abuse to which the connector and cable might be subjected.

Typically, an industrial-type connector found in such a cable assembly is provided with a backshell and a front connector combination which are mechanically connected to one another. The backshell mechanically supports and secures the cable for strain relief. The backshell often may be provided with a plurality of components for achieving shielding, sealing and/or strain relief. In practice, there have been various types of strain relief structures in the connector or backshell assemblies, three types being most prevalent. The first and most common type of strain relief is to provide a conventional split shell screw-type clamp which is positioned over the connector and backshell after assembly and then tightened by one or more screws to effect a gripping strain relief about the cable. This type of strain relief structure does not provide uniform stress throughout the clamp, and uneven wear and ultimate insulation breakage eventually may be caused at the stress points.

A second type of strain relief structure is embodied in a grommet compression-type backshell which includes a rubber or other elastomeric grommet or sleeve which is compressed onto the cable to provide strain relief therefor. The grommet usually is provided primarily as a seal for the connector, and the strain relief function is secondary and, consequently, usually inadequate. In addition, elastomeric rings do not provide uniform clamping pressure throughout the entire circumference thereof when subjected to considerable radial compressing forces.

A third type of strain relief structure is shown in U.S. Pat. No. Re. 33,611 (and corresponding parent U.S. Pat. No. 4,857,015) to Michaels et al, dated Jun. 11, 1991 and assigned to the assignee of this invention. As disclosed therein, a coiled strain relief spring is formed in a generally toroidal configuration which is dimensioned to receive an insulated cable axially therethrough. The coil spring is radially compressible to achieve a secure strain relief engagement with a jacketed cable on compression by a compression nut of the backshell assembly. This system uses few components and has been shown to give superior performance in strain relieving a cable due to the fact that the spring radially compresses as it is biased by a frustoconical camming surface, resulting in no high points of compression or stress. Still, in some applications, it has been found that the spring will rotate with the compression nut as the nut is rotatably coupled to the backshell. Rotation of the strain relief coil spring can cause wear and damage to the jacketed cable and possibly cause breakage of the individual conductors of the cable. The present invention is directed to still a further improvement wherein means are provided to prevent rotation of the strain relief coil spring when it is compressed onto the cable by relative rotation between two connector members, such as the backshell and the compression nut.

SUMMARY OF THE INVENTION

An object, therefore, of the invention is to provide an electrical connector assembly, such as a connector backshell assembly, with improved cable strain relief.

In the exemplary embodiment of the invention, a connector backshell assembly is provided for strain relief mounting to an electrical cable. The assembly includes a backshell having forward and rearward ends and an axially extending cable-receiving aperture therethrough. A toroidally configured, radially compressible strain relief coil spring surrounds the cable and is disposed near the rearward end of the backshell. Compression means are engageable with the backshell for selective rotational and axial movement relative thereto. The compression means include a forwardly facing concave cam surface for engaging and radially compressing the coil spring into strain relief engagement with the cable.

Generally, the invention contemplates the provision of interference means operatively associated with the backshell and non-rotatably engageable with the strain relief coil spring to prevent rotation of the coil spring with the rotatable compression means relative to the backshell. In particular, the interference means include axially facing serrations for non-rotatably engaging the coil spring. The serrations are provided by radially extending grooves into which individual coils of the spring can interference fit.

As disclosed herein, the assembly includes an annular cable-engaging seal within the backshell. The interference means for preventing rotation of the strain relief coil spring are provided by a seal-retaining cone mounted in the backshell near the rearward end thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
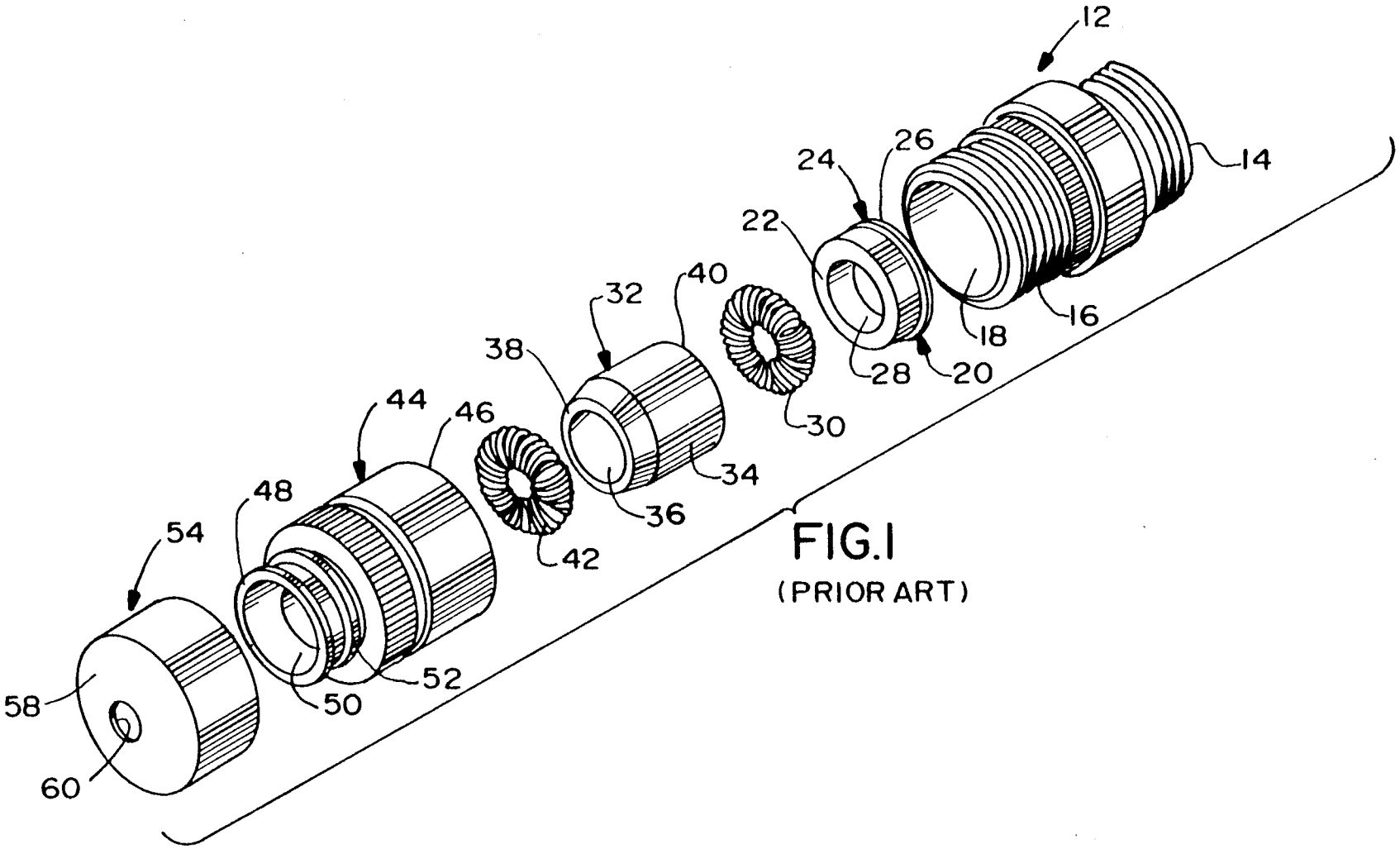
FIG. 1 (PRIOR ART)
FIG. 1 is an exploded perspective view of a backshell assembly according to the prior art.
Figure 2:
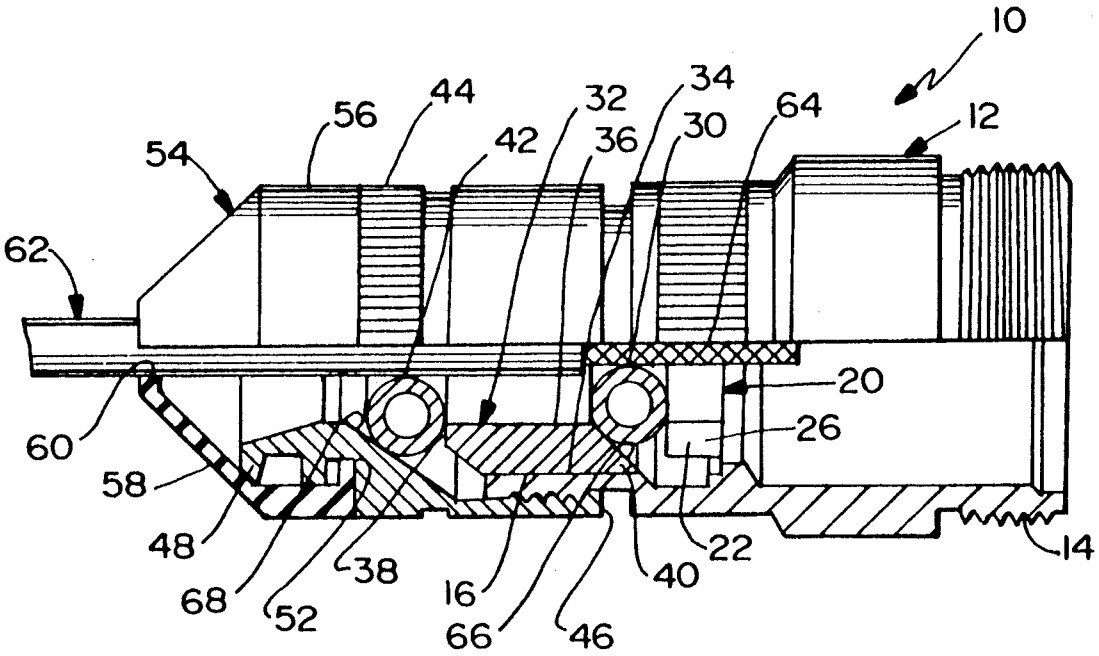
FIG. 2 (PRIOR ART)
FIG. 2 is a partial section/partial elevation of the backshell assembly of FIG. 1 in assembled condition clamping a cable therewithin.

Referring to the drawings in greater detail, and first to FIGS. 1 and 2, a backshell assembly, generally designated 10, of the prior art is shown corresponding to that of the aforementioned U.S. Pat. No. Re. 33,611 which is incorporated herein by reference. As shown most clearly in FIG. 1, the backshell assembly 10 includes a generally cylindrical, electrically conductive metallic backshell 12 having an externally threaded forward end 14 and an externally threaded rearward end 16. A generally cylindrical through aperture 18 extends entirely through backshell 12 from forward end 14 thereof to rearward end 16.

The assembly further includes a metallic reversible washer 20 having a small diameter end 22 and a large diameter end 24 which is defined by a generally annular outwardly extending flange 26. A cable receiving aperture 28 extends entirely through washer 20. Flange 26 is dimensioned to be slidably inserted into through aperture 18 of backshell 12 from rearward end 16 thereof. More particularly, flange 26 is diametrically dimensioned to be securely retained against a shoulder in the backshell 12, while small diameter end 22 of reversible washer 20 is dimensioned to pass beyond the shoulder in backshell 12. Thus, the axial position of washer 20 relative to rearward end 16 of backshell 12 can be changed by reversing washer 20.

Backshell assembly 10 further includes a grounding spring 30 which is a coiled spring formed into a generally toroidal shape. The toroidal configuration of the coiled grounding spring enables the grounding spring to be compressed radially inwardly. The dimensions of the coiled toroidal grounding spring are such that the cable can be readily inserted therethrough in the uncompressed condition of the grounding spring. However, the inward compression of grounding spring 30 is sufficient to enable the grounding spring to graspingly engage the EMI/RFI shield of the cable.

Assembly 10 further includes a plunger 32 which is of generally cylindrical configuration. More particularly, plunger 32 includes a cylindrical outer surface 34 which is dimensioned to be slidingly telescopingly received within the central through aperture 18 of backshell 12. Plunger 32 further includes a generally cylindrical interior surface 36 extending entirely therethrough. The cylindrical interior through aperture is dimensioned to slidingly receive the cable therethrough. Plunger 32 includes opposed rearward and forward ends 38 and 40, respectively. Forward end 40 of plunger 32 defines a camming surface for compressing toroidal grounding spring 30 radially inwardly and into grounding contact with the braided shield of the cable secured in backshell assembly 10.

Backshell assembly 10 further includes a coiled strain relief spring 42 which is formed into a generally toroidal configuration and which preferably, but not necessarily, is formed from metal. The toroidal strain relief spring in its unbiased condition is dimensioned to receive the insulated cable axially therethrough. However, the strain relief spring is radially compressible to achieve a secure strain relief connection to the jacketed cable. The strain relief spring is further dimensioned to be placed in abutting end-to-end relationship with rear end 38 of plunger 32 in both the unbiased and compressed conditions of strain relief spring 42.

A generally cylindrical compression nut 44, which may be formed from metallic or plastic material, is further provided as part of backshell assembly 10. The compression nut includes opposed forward and rearward ends 46 and 48, respectively. Forward end 46 is provided with an internal array of threads interengageable with externally threaded rearward end 16 of backshell 12. The interior of the compression nut 44 further is provided with a forwardly facing cam surface for engaging and compressing strain relief spring 42. The axial movement of compression nut 44 to achieve this radially inward compression of strain relief spring 42 is achieved by the threaded interconnection of compression nut 44 with backshell 12. Rearward end 48 of compression nut 44 is provided with an inwardly directed annular groove 52 disposed around the exterior thereof. The annular groove is dimensioned to lockingly engage a seal as explained further below.

Backshell assembly 10 further includes an elastomeric seal 54 having opposed forward and rearward ends 56 and 58, respectively, and having a central through aperture 60 extending entirely therethrough. Through aperture 60 adjacent the rearward end 58 of seal 54 is dimensioned to resiliently engage the jacketed cable to which backshell assembly 10 is mounted. Rearward end 58 of seal 54 is of generally convex frustoconical configuration. Forward end 56 of seal 54 includes an inwardly directed generally annular ridge (not shown in FIG. 2) which is dimensioned to engage annular groove 52 of compression nut 44.

FIG. 2 shows backshell assembly 10 of FIG. 1 in its assembled and tightened condition onto an insulated or jacketed cable 62 having a braided electrically conductive EMI/RFI shield 64. The precise details of operation of assembly 10 can be derived from the aforementioned patent. However, suffice it to say, when compression nut 44 is threadingly engaged to backshell 12, a frustoconical camming surface 66 of plunger 32 drives grounding coil spring 30 into shield 64, and a frustoconical camming surface 68 of compression nut 44 drives strain relief coil spring 42 into the outer jacket of cable 62. While assembly 10 provides a very effective shielding and strain relieving system by the use of toroidal coil springs 30 and 42, as stated in the "Background", above, in some instances there may be a tendency for coil spring 42, in particular, to rotate with the compression nut and cause damage to cable 62. The present invention is directed to solving this problem and thereby provide an improved strain relieving system.

Figure 3:
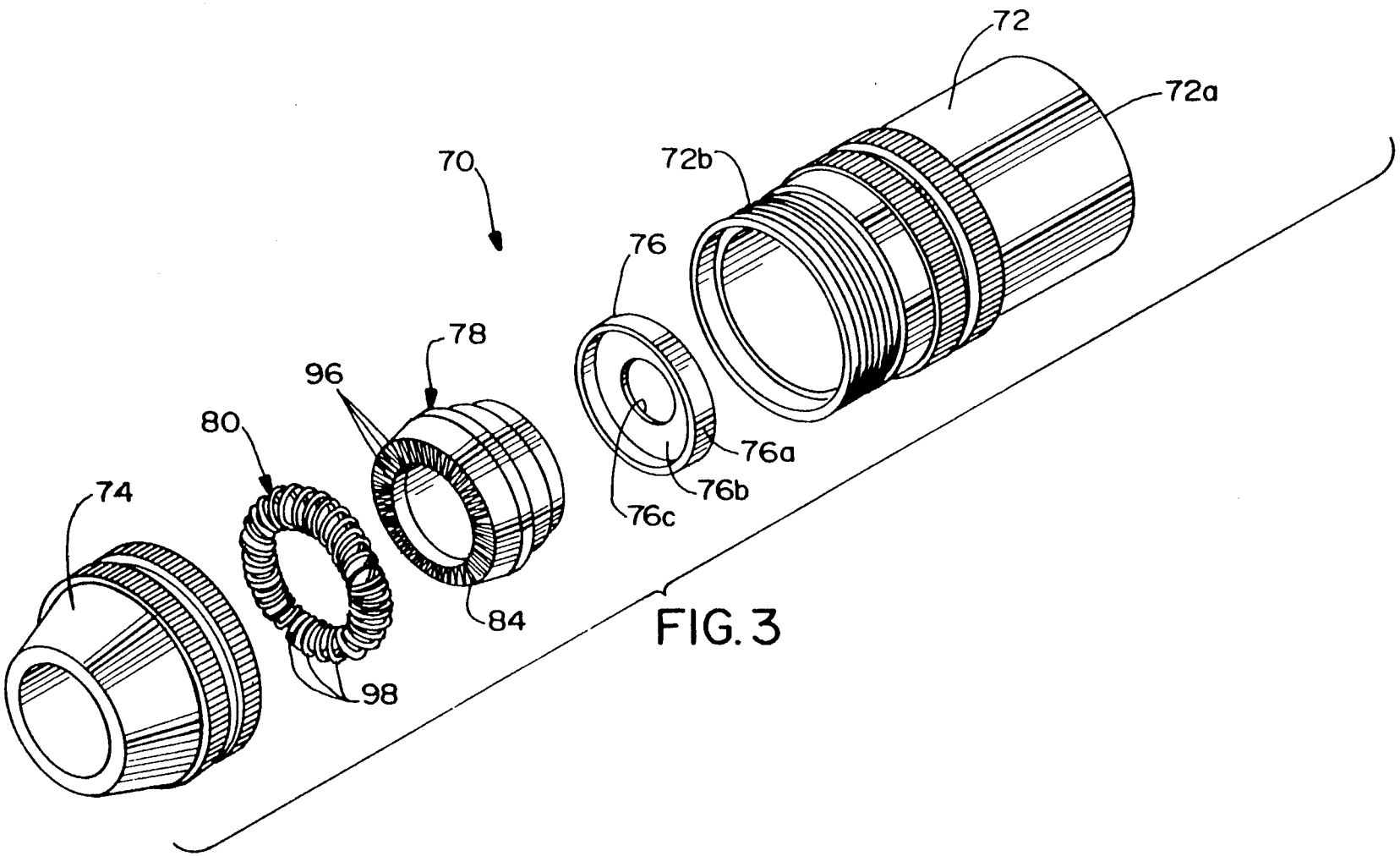
FIG. 3 is an exploded perspective view of one embodiment of a backshell assembly incorporating the concepts of the invention.

More particularly, referring to FIG. 3, a backshell assembly, generally designated 70, is designed according to the invention and includes a backshell 72 having a forward end 72*a* and an externally threaded rearward end 72*b*. An internally threaded compression nut 74 is rotatably, threadably engageable with backshell 72 for effecting selective rotational and axial movement relative thereto. A seal, generally designated 76; a plunger, generally designated 78; and a toroidally shaped strain relief coil spring, generally designated 80, are mounted within backshell 72 and compression nut 74.

Figure 4:
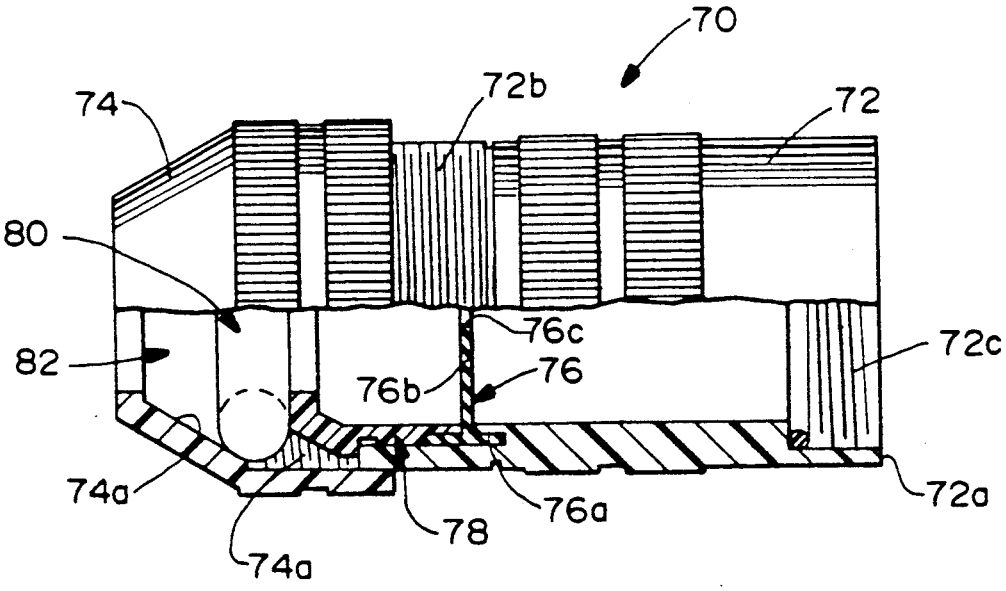
FIG. 4 is an elevational view, partially in section, of the backshell assembly of FIG. 3 in assembled condition before inserting a cable thereinto.

More particularly, referring to FIG. 4, compression nut 74 is shown to include internal threads 74*a* for threadingly engaging externally threaded end 72*b* of backshell 72. The backshell also is shown to include internal threads 72*c* inside forward end 72*a* for rotatable coupling with a complementary connector (not shown). The assembled backshell and compression nut define a cable-receiving aperture or passage extending axially therethrough, as at 82. Seal 76 is shown to include an outer cylindrical flange-type portion 76*a* and a radially extending planar portion 76*b* provided with a central aperture 76*c* for sealingly engaging a jacketed cable. Plunger 78 is seen in FIG. 4 as retaining seal 76 in proper position within backshell 72.

The invention is particularly directed to the provision of interference means to prevent rotation of strain relief coil spring 80 with compression nut 74 when the compression nut is rotated relative to backshell 72. More particularly, as best seen in FIG. 4, the compression nut includes a frustoconical camming surface 74*a* for engaging the coil spring and compressing the coil spring radially inwardly against a jacketed cable, substantially the same as the action on strain relief coil spring 42 of the prior art described in relation to FIGS. 1 and 2. However, as best seen in FIG. 3, plunger 78 has a ring-like, axially facing serrated surface 84 which engages strain relief coil spring 80. The serrated surface provides the interference means or frictional engagement with the coil spring to prevent rotation of the coil spring as compression nut 74 is rotatably, threadably engaged with backshell 72.

Figure 5:
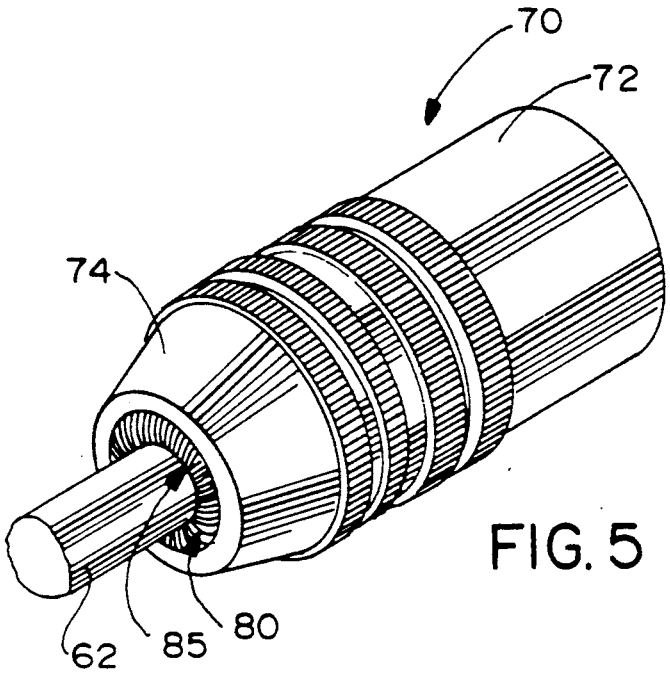
FIG. 5 is a perspective view of the backshell assembly of FIGS. 3 and 4, in strain-relief condition about a cable.

FIG. 5 shows backshell assembly 70 in fully tightened position, and it can be seen that strain relief coil spring 80 has been compressed radially inwardly to clamp jacketed cable 62, as at 85. In essence, as compression nut 74 is rotatably engaged with backshell 72, the individual coils of the coil springs are driven radially inwardly into clamping engagement with the cable and also into tight interference engagement with serrated surface 84. By preventing rotation of the coil spring, the cable is not worn or damaged and there is no possibility of breakage of the conductors within the cable which might occur with a twisting action on the cable.

Figure 6:
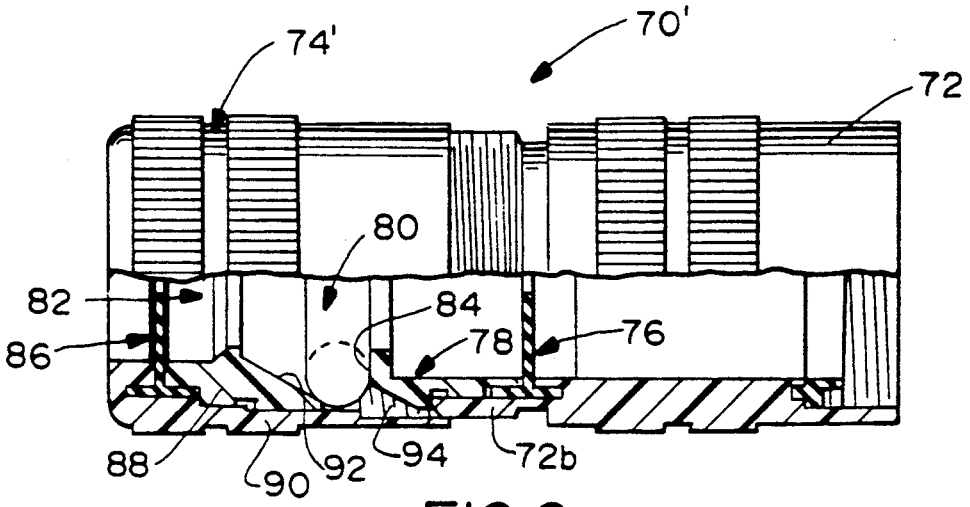
FIG. 6 is a view similar to that of FIG. 4, but of an alternate embodiment of the invention.

FIG. 6 shows an alternate embodiment of the invention wherein a backshell assembly, generally designated 70', includes a compression nut assembly, generally designated 74', rotatably coupled to backshell 72. The difference between the embodiment of FIG. 6 and the embodiment of FIG. 4 simply resides in the fact that compression nut 74 has been replaced by compression nut assembly 74'. Otherwise, seal 76, plunger 78 and strain relief coil spring 80 are mounted within or near the externally threaded rear end 72*b* of backshell 72 the same as described above in relation to the embodiment of FIG. 4.

In FIG. 6, compression nut assembly 74' includes a second seal, generally designated 86, which is held by a separate retainer ring 88 within an outer compression nut member 90. Retainer ring 88 includes a frustoconical camming surface 92 which is effective to compress strain relief coil spring 80 in a radial and axial direction. Compression nut 90 has an internally threaded end 94 for threadingly engaging externally threaded rear end 72*b* of backshell 72. Again, plunger 78 is provided with serrated surface 84 to provide an interference means to prevent rotation of coil spring 80 when compression nut assembly 74' is rotated relative to backshell 72.

Figure 7:
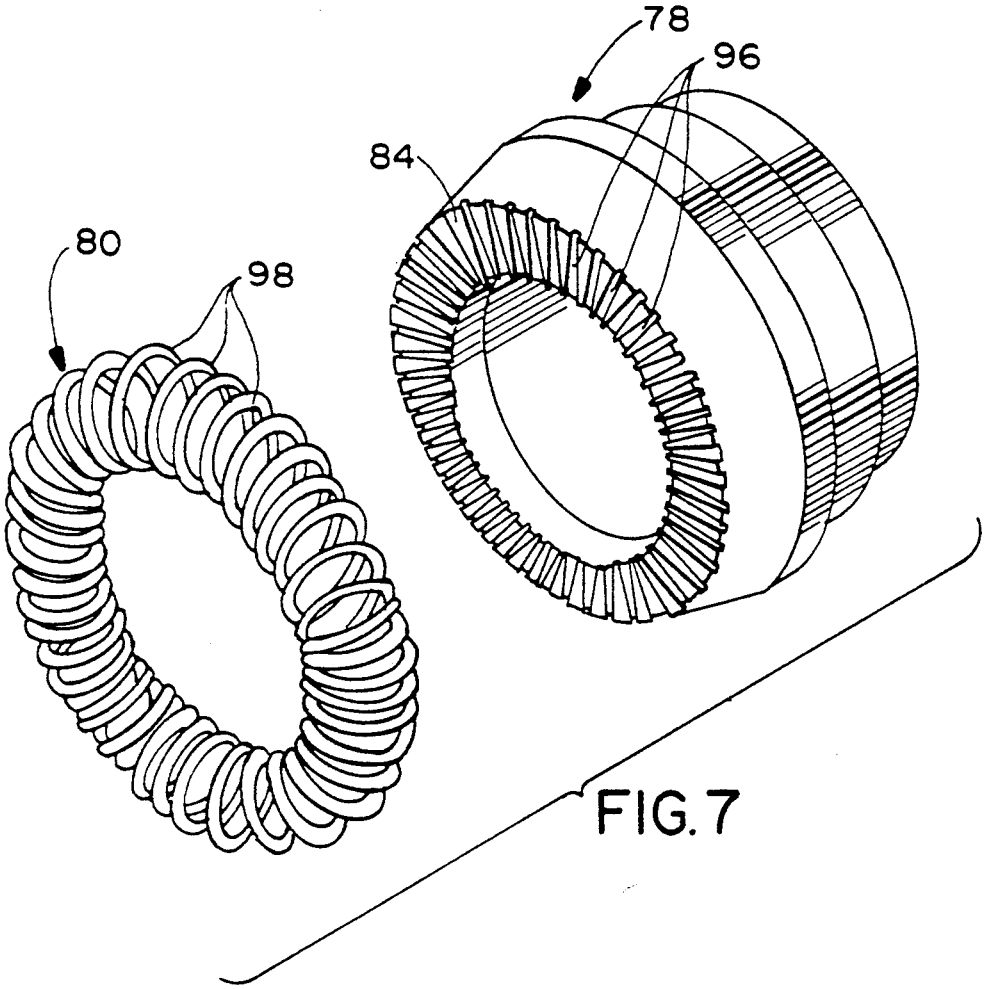
FIG. 7 is an exploded perspective view of the strain relief coil spring and the interference means incorporated in either of the embodiments of FIGS. 4 or 6.

FIG. 7 shows an enlarged depiction of strain relief coil spring 80 and plunger 78 which has the serrated surface 84 for providing the interference means to prevent rotation of the coil spring. It can be seen that the serrated surface is provided by radially extending grooves 96, whereby individual coils 98 of the coil spring can seat in the grooves in an interference fit. Therefore, the coil spring cannot rotate relative to plunger 78 as the coil spring is biased against the serrated surface 84 which defines the grooves. Since the plunger does not rotate relative to backshell 72, the coil spring will not rotate relative to cable 62 when either compression nut 74 or compression nut assembly 74' is rotatably coupled to backshell 72 to effect compression of the coil spring into strain relieving engagement with the cable.

Lastly, it should be understood that, although the interference means provided by grooves 96 in serrated surface 84 of plunger 78 are provided in the illustrated embodiments by a separate component, i.e. plunger 78, the interference means, serrated surface or grooves equally can be formed directly on the backshell itself and thereby prevent rotation of the coil spring. The interference means are provided on the plunger in the illustrated embodiments because the embodiments include seal 76 which is held in place by the plunger. The invention contemplates other types of connectors wherein seals, such as seal 76, might not be employed, but an interference means can be provided between two relatively rotatable members of a connector assembly, wherein one of the members is provided with an interference means to prevent rotation of the strain relief coil spring relative to a terminated cable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a connector backshell assembly for strain relief mounting to an electrical cable, including a backshell having forward and rearward ends and an axially extending cable-receiving aperture therethrough, a toroidally configured radially compressible strain relief coil spring for surrounding the cable and disposed near the rearward end of the backshell, and compression means engageable with the backshell for selective rotational and axial movement relative thereto, the compression means including a forwardly facing concave cam surface for engaging and radially compressing the coil spring into strain relief engagement with the cable, wherein the improvement comprises interference means operatively associated with the backshell and non-rotatably engageable with the strain relief coil spring to prevent rotation of the coil spring with the rotatable compression means relative to the backshell, said interference means including axially facing seriations for non-rotatably engaging the coil spring.

2. In a connector backshell assembly as set forth in claim 1, wherein said serrations comprise radially extending grooves into which individual coils of the spring can interference fit.

3. In a connector backshell assembly as set forth in claim 1, wherein the assembly includes an annular cable-engaging seal within the backshell, and said interference means are provided by a seal-retaining member mounted in the backshell near the rearward end thereof.

4. In, a connector backshell assembly as set forth in claim 3, wherein said interference means comprise axially facing serrations on the seal-retaining member and non-rotatably engaging the coil spring.

5. In a connector backshell assembly as set forth in claim 4, wherein said serrations comprise radially extending grooves into which individual coils of the spring can interference fit.

6. In an electrical connector assembly for strain relief mounting to a cable, the assembly including first and second rotatably coupled members defining an axially extending cable-receiving passage therethrough, and a toroidally configured radially compressible strain relief coil spring for surrounding the cable, the coil spring being sandwiched between the first and second members and being radially compressible into strain relief engagement with the cable in response to relative rotation of the members, wherein the improvement comprises interference means on one of said first and second members non-rotatably engageable with the strain relief coil spring to prevent rotation of the coil spring with the other member relative to the one member.

7. In an electrical connector assembly as set forth in claim 6, wherein said interference means include axially facing serrations for non-rotatably engaging the coil spring.

8. In an electrical connector assembly as set forth in claim 7, wherein said serrations comprise radially extending grooves into which individual coils of the spring can interference fit.

* * * * *